US005484509A

United States Patent [19]

Famili et al.

[11] Patent Number: 5,484,509

[45] Date of Patent: Jan. 16, 1996

[54] SURFACE SIZING COMPOSITION AND METHOD

[75] Inventors: Amir Famili, Orefield; Gerald D. Miller, Emmaus, both of Pa.

[73] Assignee: Air Products and Chemicals, Inc., Allentown, Pa.

[21] Appl. No.: 285,259

[22] Filed: Aug. 3, 1994

Related U.S. Application Data

[63] Continuation of Ser. No. 54,659, Apr. 23, 1993, abandoned, which is a continuation-in-part of Ser. No. 17,050, Feb. 12, 1993, abandoned.

[51] Int. Cl.[6] ..... D21H 21/16

[52] U.S. Cl. ..... 162/135; 162/158; 162/179; 162/168.1; 106/243; 106/287.2; 106/287.24; 427/391; 427/395

[58] Field of Search ..... 162/158, 135, 162/179, 168.1; 106/287.2, 287.23, 287.24; 427/391, 395

[56] References Cited

U.S. PATENT DOCUMENTS

| | | | |
|---|---|---|---|
| 2,627,477 | 2/1953 | Downey | 162/158 |
| 2,762,270 | 9/1956 | Keim | 162/158 |
| 4,296,012 | 10/1981 | Okumichi et al. | 162/168.1 |
| 4,919,724 | 4/1990 | Cenisio et al. | 162/158 |
| 5,013,775 | 5/1991 | Oikawa et al. | 524/107 |
| 5,154,763 | 10/1992 | Ksoll et al. | 162/158 |

FOREIGN PATENT DOCUMENTS

| | | | |
|---|---|---|---|
| 45-33189 | 10/1970 | Japan . | |
| 60-17198 | 1/1985 | Japan | 162/168.1 |
| 60-246896 | 12/1985 | Japan . | |
| 1457428 | 12/1976 | United Kingdom . | |

*Primary Examiner*—Peter Chin
*Attorney, Agent, or Firm*—Michael Leach; William F. Marsh

[57] ABSTRACT

A method for treating paper which comprises applying to the surface of the paper an aqueous medium containing a sizing composition consisting essentially of 75 to 99.9 wt % polyvinyl alcohol which is at least 95 mole % hydrolyzed and 0.1 to 25 wt % ketene dimer represented by the formula:

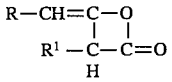

wherein R and $R^1$ are the same or different hydrocarbyl groups having 8–30 carbon atoms.

22 Claims, No Drawings

SURFACE SIZING COMPOSITION AND METHOD

CROSS-REFERENCE TO RELATED APPLICATION

This is a continuation of application Ser. No. 08/054,659 filed 23 Apr. 1993 which is a continuation-in-part of application Ser. No. 08/017,050 filed 12 Feb. 1993 both now abandoned.

FIELD OF THE INVENTION

The present invention relates to a surface sizing composition useful in papermaking processes.

BACKGROUND OF THE INVENTION

In the manufacture of ordinary paper and paperboard, "sizing" is effected in order to provide the products with resistance to blotting, water resistance, waterproofness, and the like. Such sizing includes "internal sizing" in which a sizing agent is added to a furnish during the papermaking process before a fiber sheet is formed and "surface sizing" in which a sizing agent is applied on the surface of formed fiber sheet.

In internal sizing, there is employed an acid sizing in which sizing is carried out in a pH range of 4.5–6.5 using rosin sizing agents and crude aluminum sulfate. There is also employed, with increasing popularity, a neutral or alkaline papermaking technique using calcium carbonate as a filler. Here, paper is made in a pH range of 6.5–9 where rosin and alum do not work well, and are sized with ketene dimer compounds, substituted cyclic dicarboxylic acid anhydride compounds, copolymers of a cationic monomer and a hydrophobic monomer, cationized petroleum resins, cationized aliphatic amides and the like. Among these, aqueous dispersions of ketene dimer compounds are most widely used because of their superior sizing effect.

Internal sizing, despite widespread popularity, suffers from the disadvantage of not fully staying with the cellulose fibers during the dewatering phase of the papermaking operation, thus incurring significant losses. In so-called closed-loop papermaking operations, the chemicals lost during the dewatering phase are trapped with the water and recirculated to all phases of the papermaking operation. Often, hydrolyzed diketene by-products deposit on various parts of the paper machine, sometimes redepositing onto the paper itself as contamination, or onto the paper machine causing buildup and ultimately down-time for cleanup.

The surface application of hydrophobes is advantageous in that all of the sizing agent is retained on the paper. However, ketene dimer compounds are inherently reactive with water and are difficult to provide as stable aqueous dispersions. It is very difficult to provide an aqueous dispersion sizing agent which is both stable at high temperatures and mechanically stable. To the inventors' knowledge, ketene dimer, by itself, is not used as a surface size on a commercial scale.

In surface sizing, the sizing agent is, on some occasions, required to provide the paper with surface bonding strength and good printability in addition to blotting resistance.

Korean patent publication 89-1974 discloses a method for manufacturing neutral paper and recommends using a surface size such as styrene-maleic anhydride copolymer, alkyl ketene dimer (AKD), polyvinyl alcohol (PVOH), or any combination thereof. The examples do not show the use of AKD and PVOH together.

JP 45-33189 discloses a PVOH resin which is characterized by the fact that a vinyl ester and a higher alkyl ketene dimer are copolymerized and saponified.

JP 60-246896 discloses a sizing agent composition wherein a cationized PVOH is added as an emulsification stabilizer to a sizing agent that is used in neutral paper manufacture, which sizing agent may be alkenyl succinic anhydrides, AKD's, AKD derivatives, and stearic anhydride.

U.S. Pat. No. 5,013,775 discloses a paper sizing composition comprising a ketene dimer and a hydroplilic vinyl polymer containing an alkyl mercaptan having 6–22 carbon atoms.

GB 1,457,428 discloses sizing agents using organic ketene dimers and teaches that emulsions of high ketene dimer content can be prepared without the use of cationic starch by emulsifying the ketene dimer with polyvinyl alcohol together with a relatively small proportion of a secondary emulsifier in the form of sodium lignosulphonate.

SUMMARY OF THE INVENTION

The present invention provides a sizing composition for surface application to formed paper sheet, which composition comprises 50–99.9 wt % fully hydrolyzed PVOH and 0.1–50 wt % ketene dimer compound (solids/solids). The preferred embodiment comprises 1–15 wt % of the surface sizing composition in an aqueous medium.

Also provided is a method for making paper which comprises applying to the paper sheet the surface size composition at a rate of 1–10 g/m$^2$, the composition being applied in an aqueous medium.

The present invention advantageously provides a hydrophobically modified PVOH that affords improved water repellency properties when applied to paper as a surface sizing composition. When such surface sizing compositions are applied to paper not previously sized via wet end addition, the surface sized paper exhibits the same high degree of sizing (repellency) as is typical of papers sized with AKD by wet end addition. Moreover, much less AKD is used in the present surface sizing method than in wet end addition to achieve the same sizing level.

DETAILED DESCRIPTION OF THE INVENTION

A ketene dimer compound useful in the present invention may be represented by the formula:

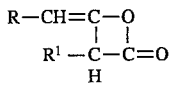

wherein R and $R^1$ are the same or different hydrocarbyl groups having 8–30 carbon atoms.

Ketene dimer compounds are known and may be conveniently prepared by known methods. One such method is the dehydrohalogenation of acid chlorides by aliphatic tertiary amines as described in the Journal of the *American Chemical Society*, Vol. 69, pp. 24444–8.

In the formula R and $R^1$ are the same or different hydrocarbyl groups having 8–30 carbon atoms, including alkyl groups such as decyl, dodecyl, tetradecyl, hexadecyl, eicosyl, and the like; alkenyl groups such as tetradecenyl, hexadecenyl, octydecenyl, and the like; alkyl substituted phenyl groups, such as octylphenyl, nonylphenyl, and the like; alkyl substituted cycloalkyl groups, such as nonylcyclohexyl, and the like; aralkyl groups such as phenylethyl. It is preferred that R and $R^1$ be alkyl groups, i.e., alkyl ketene dimers (AKD). The ketene dimer compounds can be used singly or in combination of one or more.

Alkyl ketene dimers (AKD) are commercially available as aqueous dispersions or solids from Hercules Inc. under the trademarks Aquapel and Hercon, for example, Aquapel 610 and Aquapel 364 size, and the preferred aqueous Hercon 70 and Hercon 24D reactive size dispersions. It has been found that the commerially available ketene dimer solids do not perform nearly as well as the aqueous ketene dimer dispersions in the surface sizing compositions.

Fully hydrolyzed PVOHs suitable for use in the present invention are those which are at least 95 mole % hydrolyzed, preferably at least 98 mole % and ideally about 99.3 mole % hydrolyzed (superhydrolyzed). Such fully hydrolyzed PVOHs having a degree of polymerization (DPn) from 100 to 3000 can be suitably used, preferably a DPn of 300 to 2500. The PVOHs may be used singly or in combinations. Such PVOHs are commercially available from Air Products and Chemicals, Inc. under the trademark AIRVOL®. It is important that the PVOH be at least 95 mole % hydrolyzed in order to achieve the sizing benefits when blended with ketene dimer. Partially hydrolyzed (88 mole %) PVOH shows very little sizing development when blended with ketene dimer and cannot be used effectively. It is preferred to use superhydrolyzed grades (99.3+ mole % hydrolyzed) such as Airvol 125 and 165 PVOHs.

Contemplated as functional equivalents to the above-described PVOHs for the purpose of this invention are copolymers of vinyl alcohol containing up to 6 mole % copolymerized monomer. For example, copolymers of vinyl alcohol and methyl methacrylate consisting of 94–98 mole % vinyl alcohol and 2–6 mole % methyl methacrylate as disclosed in U.S. Pat. No. 3,689,469 are considered suitable equivalents to the vinyl alcohol and vinyl acetate copolymer containing the same mole % alcohol units.

The surface size composition would comprise 50–99.9 wt % fully hydrolyzed PVOH and 0.1 to 50 wt % ketene dimer, preferably 75 to 99.9 wt % PVOH and 0.1 to 25 wt % ketene dimer. The most preferred compositions comprise 97 to 99 wt % PVOH and 1 to 3 wt % ketene dimer. Such surface sizing compositions are applied as their aqueous solutions which contain 1 to 15 wt % of the surface size composition, preferably 3 to 8 wt %, dissolved in water.

When the surface sizing composition is used, starch derivatives, such as oxidized starch, starch phosphates, and the like; carboxymethyl cellulose; anionic water-soluble polymers such as anionic acrylamide polymers may also be added to the composition.

The sizing composition should be prepared by wet blending methods known in the art. For example, an aqueous ketene dimer dispersion, such as Hercon 70 reactive size from Hercules, Inc. (12.5% solids), can be added to the PVOH in water before, during or after "cookout" of the PVOH.

In order to prepare an aqueous mixture of the PVOH/ketene dimer blend, it must be "cooked out" in water the same way as any standard, fully hydrolyzed PVOH grade: add the PVOH to unheated water with mixing, elevate the temperature, preferably using live steam injection, and hold at temperature for sufficient time to effect substantial dissolution of the PVOH, for example 30 minutes at 200° F. (93° C.). The aqueous ketene dimer dispersion may be added at any time to the PVOH/water mixture, i.e., before, during or after the "cooking out" process. The resulting mixture is typically hazy.

The aqueous surface sizing composition is applied to or impregnated in the fiber sheet after it is formed. The composition in aqueous solution may be applied to the paper surface by a size press, gate roll coater, Billblade coater, calendar, and the like, in amounts such that the solids content of the composition is applied to the paper at a rate of 1–10 g/m$^2$, preferably 2–5 g/m$^2$.

The paper to which the sizing composition is applied as the surface size is not specifically limited. The paper may already contain an internal sizing agent.

The sizing composition is applicable to papers comprising bleached or unbleached pulp, such as kraft pulp, and sulfite pulp; bleached or unbleached high yield pulp, such as ground wood pulp, mechanical pulp, thermomechanical pulp, waste paper (newspaper and magazine), waste corrugated board, deinked waste paper, and the like.

When surface supplied via aqueous medium, the sizing composition imparts remarkable improvements in Cobb Water Absorption Test and Hercules Sizing Test (HST) values (greater water repellency) with both acid and alkaline papers; and little or no loss in sizing values over a 2–3 month testing period. (The Cobb test measures the grams of water absorbed in 1.75 min; HST measures the time for ink penetration—both tests reflecting the degree of sizing of the paper). Also, the surface application approach can minimize costly wet end losses of wet end sizing agents and is an easier process to control.

It is speculated that the ketene dimer dispersions alone are simply too unstable to mechanical shear to withstand the shear forces in the nip of a size press. However, when the ketene dispersion is blended with the PVOH in hot water, the inventors' laboratory studies showed that ketene dimer did apply well and did result in excellent "sizing" values in Example 1.

In the following Examples 1–4, the PVOH/ketene dimer blend was prepared by wet blending techniques in which the PVOH was first cooked out in water and the aqueous ketene dimer dispersion subsequently added.

EXAMPLE 1

In this example various materials alone and in combination were applied from an aqueous medium and evaluated as surface sizing compositions as shown in Table 1.

TABLE 1

| Surface Treatment | % Solids Applied | Cobb Water Absorption g/m$^2$ | Hercules HST, sec |
|---|---|---|---|
| BASE A | | 225 | 2 |
| Starch | 6 | 230 | 5 |
| Starch/Hercon 70 | 5.9/0.1 | 231 | 5 |
| Airvol 107[a] | 6 | 203 | 7 |
| Airvol 107/Hercon 70 | 5.99/0.01 | 53 | 14 |
| Airvol 125[b]/Hercon 70 | 5.99/0.01 | 29 | 63 |
| Hercon 70 | 0.01 | 56 | 29 |
| Hercon 70 | 0.1 | 24 | 151 |
| Hercon 70 | 3.0 | 22 | 500 |

[a]98 mole % hydrolyzed; DPn = 500–700
[b]99.3 mole % hydrolyzed; DPn = 1800

On the base paper (A), neither starch nor the PVOH treatment by themselves showed much improvement over the base paper. However, when combined with Hercon 70 AKD, fully hydrolyzed Airvol 107 and Airvol 125 PVOHs exhibited dramatic improvement, whereas starch showed none at all despite a 10 times higher Hercon 70 AKD level. Hercon 70 AKD alone also exhibited excellent sizing even at the 0.01% level. However, an unknown in the study was the amount of dry add-on of the Hercon 70 AKD treatment. Given that straight aqueous Hercon 70 AKD systems were water thin (low viscosity), it would be expected for such AKD systems to saturate the base paper to a greater degree resulting in higher dry add-ons. Therefore, it would be expected that the 0.01% Hercon 70 AKD solids system would be higher in dry add-on than the 5.99%/0.01% PVOH/Hercon 70 systems. In contrast, Hercon 70 AKD at a 10 times higher add-on (0.1%) with starch showed no improvement.

Example 2

This example shows the performance of the superhydrolyzed AIRVOL 125 PVOH/ketene dimer blend on internally sized paper and non-sized paper. It can be seen that the sizing composition was significantly superior for both Cobb Water Absorption and Hercules Sizing Test.

TABLE 2

| Base | Internally "Sized" | Surface Treatment | % Solids Applied | Cobb Water Absorption g/m² | Hercules HST, sec |
|---|---|---|---|---|---|
| B | Yes | None | — | 42 | 31 |
| B | Yes | A-125/ Hercon 70 | 5/0.1 | 34 | 258 |
| C | No | None | — | 392 | 1 |
| C | No | A-125/ Hercon 70 | 5/0.1 | 30 | 205 |

EXAMPLE 3

This example compares partially hydrolyzed Airvol 205 PVOH (87–89 mole % hydrolyzed; DPn=550–700) with fully hydrolyzed Airvol 107 and 125 PVOHs, with and without Hercon 70 AKD.

TABLE 3

| Surface Treatment | PVOH % Hydrolysis | % Solids Applied | Cobb Water Absorption g/m² | Hercules HST, Sec |
|---|---|---|---|---|
| Base D | — | — | 330 | 1 |
| AIRVOL 205 | 88 | 5 | 300 | 1 |
| AIRVOL 107 | 98 | 5 | 270 | 1 |
| AIRVOL 125 | 99.3 | 5 | 105 | 10 |
| A-205/ Hercon 70 | 88 | 4.95/0.05 | 300 | 1 |
| A-107/ Hercon 70 | 98 | 4.95/0.05 | 170 | 8 |
| A-125/ Hercon 70 | 99.3 | 4.95/0.05 | 40 | 70 |
| A-205/ Hercon 70 | 88 | 4.925/0.075 | 300 | 1 |
| A-107/ Hercon 70 | 98 | 4.925/0.075 | 130 | 10 |
| A-125/ Hercon 70 | 99.3 | 4.925/0.075 | 30 | 120 |

It can be seen that the use of partially hydrolyzed Airvol 205 PVOH showed no significant benefits with or without AKD compared to the base paper itself. However, fully hydrolyzed AIRVOL 107 PVOH was much improved in both the Cobb Water Absorption and HST results. Best of all was the super hydrolyzed (99.3 mole %) AIRVOL 125 PVOH in combination with AKD.

EXAMPLE 4

This example demonstrates that, when surface applied, the surface sizing composition according to the invention imparts remarkable improvements in Cobb and Hercules Sizing Test values (greater water repellency) with both acid and alkaline papers. In addition, little or no loss in sizing values occurred over a 2–3 month testing period.

The fully hydrolyzed PVOH/AKD sizing composition comprised 98 wt % AIRVOL 125 PVOH and 2 wt % HERCON 70 reactive size and was applied as an aqueous solution at 5% solids to both sides of two different paper substrates by Keegan size press and dried with a forced air oven. The papers were equilibrated to TAPPI conditions prior to testing.

TABLE 4

| Surface Treatment | Cobb Valve g/m² Initial | Cobb Valve g/m² 2–3 Months | HST sec Initial | HST sec 2 Months |
|---|---|---|---|---|
| Base Acidic | 330 | — | 1 | — |
| A-125/ Hercon 70 | 30 | 29 | 205 | 195 |
| Base Alkaline | 375 | — | 1 | — |
| A-125/ Hercon 70 | 30 | 29 | 140 | 130 |

The Cobb Test results (Cobb values of 320 and 375 g/m²) indicate that the two base papers nave no internal size. Equally important, the Cobb values showed no decline of the performance of the surface sizing composition over a 2–3 month period.

The HST values (less than 1 second for ink penetration) substantiate the lack of internal size of the base papers. When surface treated with the surface size of the invention, the HST values improved to 205 seconds and 140 seconds, respectively, for the two papers. Again, the values showed no significant decline over a two month time period.

EXAMPLE 5

In this Example the aqueous PVOH/AKD solutions were prepared by two different methods, i.e., a wet blending process and a dry blending process. In wet blending the indicated aqueous ketene dimer dispersion was added to an aqueous AIRVOL 125 PVOH dispersion followed by cooking out. In dry blending the indicated aqueous ketene dimer dispersion was added to dry AIRVOL 125 PVOH to yield a dry powder which was subsequently added to water and cooked out. The PVOH/AKD blend was applied at 5% solids to a base paper.

In Table 5 the "Aged" values represent the following: for dry blending—the elapsed time from the preparation of the PVOH/AKD dry blend to its addition to water and cookout; for wet blending—the elapsed time from cookout of the PVOH/AKD wet blend to application to the base paper.

TABLE 5

| AKD Type | Blending Method | % AKD on PVOH (d/d) | Aged (Hr) | % Solids Applied | COBB ABS. ($g/m^2$) | HST (sec) |
|---|---|---|---|---|---|---|
| None | — | — | — | — | 360 | 0.8 |
| Hercon 24D | Dry | 2 | 2 | 5 | 35 | 120 |
| Hercon 24D | Dry | 2 | 24 | 5 | 68 | 14 |
| Hercon 24D | Dry | 2 | 48 | 5 | 66 | 12 |
| Hercon 24D | Wet | 2 | 2 | 5 | 31 | 112 |
| Hercon 24D | Wet | 2 | 24 | 5 | 30 | 91 |
| Hercon 24D | Wet | 2 | 48 | 5 | 31 | 87 |
| Hercon 70 | Dry | 1.4 | 2 | 5 | 32 | 91 |
| Hercon 70 | Dry | 1.4 | 24 | 5 | 68 | 13 |
| Hercon 70 | Dry | 1.4 | 48 | 5 | 70 | 12 |
| Hercon 70 | Wet | 1.4 | 2 | 5 | 33 | 97 |
| Hercon 70 | Wet | 1.4 | 24 | 5 | 33 | 65 |
| Hercon 70 | Wet | 1.4 | 48 | 5 | 31 | 73 |

It can be seen from the data in Table 5 that addition of the AKD dispersion to dry PVOH (dry blending) and aging for two hours gave surface sizing performance comparable to the same PVOH/AKD blending prepared by wet blending. Longer aging of the dry blended compositions showed a significant deterioration in Cobb and HST values although still much better than the base case. In contrast, the wet blended compositions demonstrated no loss in Cobb values but did show about a 25% loss in HST values.

EXAMPLE 6

This Example demonstrates the shear effects (30 seconds in Waring blender) on the performance of PVOH/AKD surface sizing compositions on base paper. The PVOH/AKD compositions were prepared by adding the aqueous ketene dimer dispersion to the PVOH dispersion which was then cooked out. The data in Table 6 shows that shearing forces on the aqueous PVOH/AKD blend de not affect the Cobb Water Absorption values but do adversely affect the HST values by about one-third.

TABLE 6

| Surface Treatment | % Solids Applied | Post-Cook Shear | COBB ABS. ($g/m^2$) | HST (sec) |
|---|---|---|---|---|
| None | — | — | 360 | 0.8 |
| Airvol 125/Hercon 24D | 4.99/0.01 | None | 31 | 112 |
| Airvol 125/Hercon 24D | 4.99/0.01 | Yes | 32 | 73 |
| Airvol 125/Hercon 70 | 4.93/0.07 | None | 33 | 96 |
| Airvol 125/Hercon 70 | 4.93/0.07 | Yes | 32 | 64 |

In summary, when the sizing composition is preferably wet blended, cooked out and applied to the surface of paper as an aqueous solution and the paper dried, the paper exhibits a very high degree of "sizing". This is true with both acid and alkaline paper as determined by industry standards Cobb Water Absorption Test and Hercules Sizing Test. More importantly, this improvement is achieved at much lower ketene dimer levels than when ketene dimer is applied by itself in the wet end of the papermaking process.

STATEMENT OF INDUSTRIAL APPLICATION

The present invention provides a surface sizing composition for use in papermaking process.

We claim:

1. A method for treating paper which comprises applying to the surface of the paper an aqueous 1–15 wt % polyvinyl alcohol sizing composition consisting essentially of 75–99.9 wt % polyvinyl alcohol which is at least 95 mole % hydrolyzed and 0.1– 25 wt % ketene dimer.

2. The method of claim 1 in which the sizing composition is applied at 1–10 $g/m^2$.

3. The method of claim 1 in which the ketene dimer is represented by the formula:

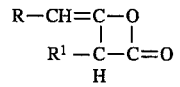

wherein R and $R^1$ are the same or different hydrocarbyl groups having 8–30 carbon atoms.

4. The method of claim 2 in which R and $R^1$ are the same or different $C_8$–$C_{30}$ alkyl groups.

5. The method of claim 1 in which the polyvinyl alcohol is at least 98 mole % hydrolyzed.

6. The method of claim 1 in which the polyvinyl alcohol has a degree of polymerization of 100–3000.

7. The method of claim 1 in which the polyvinyl alcohol sizing composition consists essentially of 97–99 wt % polyvinyl alcohol and 1–3 wt % ketene dimer.

8. The method of claim 1 in which the aqueous polyvinyl alcohol sizing composition is prepared by blending an aqueous polyvinyl alcohol mixture and an aqueous ketene dimer composition.

9. A method for treating paper which comprises applying an aqueous 1–15 wt % polyvinyl alcohol sizing composition to the surface of the paper to provide 1–10 $g/m^2$ of the sizing composition which consists essentially of 75–99.9 wt % polyvinyl alcohol which is at least 98 mole % hydrolyzed and has a degree of polymerization of 100–3000 and 0.1–25 wt % ketene dimer which is represented by the formula:

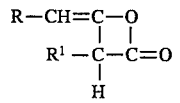

wherein R and $R^1$ are the same or different hydrocarbyl groups having 8–30 carbon atoms.

10. The method of claim 9 in which the sizing composition is applied at 2–5 $g/m^2$ and consists essentially of 97–99 wt % polyvinyl alcohol which is at least 98 mole % hydrolyzed and has a degree of polymerization of 300–2500 and 1–3 wt % ketene dimer in which R and $R^1$ are the same or different $C_8$–$C_{30}$ alkyl groups.

11. The method of claim 10 in which the polyvinyl alcohol is about 99.3 mole % hydrolyzed.

12. The method of claim 9 in which the sizing composition is applied as an aqueous solution containing 3 to 8 wt % of the sizing composition.

13. The method of claim 10 in which the sizing composition is applied as an aqueous solution containing 3 to 8 wt % of the sizing composition.

14. The method of claim 9 in which the aqueous polyvinyl alcohol sizing composition is prepared by blending an aqueous polyvinyl alcohol mixture and an aqueous ketene dimer composition.

15. An aqueous 1–15 wt % polyvinyl alcohol surface sizing composition consisting essentially of 75 to 99.9 wt % polyvinyl alcohol which is at least 95 mole % hydrolyzed and 0.1 to 25 wt % ketene dimer represented by the formula:

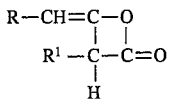

wherein R and $R^1$ are the same or different hydrocarbyl groups having 8–30 carbon atoms.

16. The composition of claim 15 in which R and $R^1$ are the same or different $C_8$–$C_{30}$ alkyl groups.

17. The composition of claim 16 in which the polyvinyl alcohol is at least 98 mole % hydrolyzed.

18. The composition of claim 17 in which the polyvinyl alcohol has a degree of polymerization of 100–3000.

19. The composition of claim 15 in which the sizing composition consists essentially of 97–99 wt % polyvinyl alcohol and 1–3 wt % ketene dimer.

20. The composition of claim 15, in which the sizing composition consists essentially of 97–99 wt % polyvinyl alcohol which is at least 98 mole % hydrolyzed and has a degree of polymerization of 300–2500 and 1–3 wt % ketene dimer in which R and $R^1$ are the same or different $C_8$–$C_{30}$ alkyl groups.

21. The composition of claim 20 in which the polyvinyl alcohol is about 99.3 mole % hydrolyzed.

22. The aqueous polyvinyl alcohol sizing composition of claim 15 which is prepared by blending an aqueous polyvinyl alcohol mixture and an aqueous ketene dimer composition.

* * * * *